US007387350B2

(12) United States Patent
Killinger et al.

(10) Patent No.: US 7,387,350 B2
(45) Date of Patent: Jun. 17, 2008

(54) STORAGE CONTAINER HAVING DUAL ACCESS

(75) Inventors: Timothy D. Killinger, Wooster, OH (US); Gilius A. Gaska, Madison, WI (US); Michael L. Pyle, Cambridge, WI (US); John C. Olson, Chicago, IL (US)

(73) Assignee: Rubbermaid Incorporated, Wooster, OH (US)

( * ) Notice: Subject to any disclaimer, the term of this patent is extended or adjusted under 35 U.S.C. 154(b) by 532 days.

(21) Appl. No.: 10/798,137

(22) Filed: Mar. 11, 2004

(65) Prior Publication Data

US 2005/0040064 A1 Feb. 24, 2005

Related U.S. Application Data

(60) Provisional application No. 60/453,493, filed on Mar. 11, 2003.

(51) Int. Cl.
*A47B 87/02* (2006.01)

(52) U.S. Cl. ..... 312/290; 312/108; 220/817

(58) Field of Classification Search ..... 312/107, 312/108, 257.1, 290, 283, 286, 330.1; D9/425; 206/503, 508; 220/640, 643, 810, 817, 836, 220/840, 846; D3/312, 323
See application file for complete search history.

(56) References Cited

U.S. PATENT DOCUMENTS

| | | | | |
|---|---|---|---|---|
| 16,829 | A | 3/1857 | French | |
| 898,034 | A | 9/1908 | Brunn | |
| 1,021,598 | A | 3/1912 | Harrington | |
| 1,119,925 | A | 12/1914 | Chatham | |
| 1,465,244 | A | 8/1923 | Hager | |
| 1,999,157 | A | 4/1935 | Rand | 129/16 |
| 2,520,508 | A * | 8/1950 | Morrison | 220/832 |
| 3,152,716 | A * | 10/1964 | Feldhahn | 220/230 |
| 3,383,009 | A * | 5/1968 | Weikert | 206/506 |
| 3,710,761 | A * | 1/1973 | Gregory | 119/496 |
| 3,758,181 | A * | 9/1973 | Bolyos | 312/107 |
| 3,876,077 | A | 4/1975 | Jones | 211/11 |
| 4,444,314 | A | 4/1984 | Jacobsson | 206/425 |
| 4,706,396 | A | 11/1987 | Nomura | 40/124.2 |
| 4,871,066 | A | 10/1989 | LaWall | 206/425 |
| 5,025,979 | A | 6/1991 | Dellacroce | 229/1.5 R |
| 5,065,887 | A * | 11/1991 | Schuh et al. | 220/835 |
| 5,125,697 | A * | 6/1992 | Kahl et al. | 292/204 |
| 5,180,191 | A | 1/1993 | Biba | 281/45 |
| 5,205,413 | A * | 4/1993 | Cautereels et al. | 206/541 |
| D355,118 | S * | 2/1995 | Dickinson et al. | D9/425 |
| D360,778 | S * | 8/1995 | Apt et al. | D6/448 |
| 5,487,617 | A | 1/1996 | Cole et al. | 402/4 |
| 5,503,435 | A | 4/1996 | Kline | 283/67 |
| D379,122 | S * | 5/1997 | Wolff | D3/312 |

(Continued)

*Primary Examiner*—James O Hansen
(74) *Attorney, Agent, or Firm*—Marshall, Gerstein & Borun LLP

(57) ABSTRACT

A storage container having dual access includes a storage frame, a container lid and a drawer. The storage frame includes a bottom frame, a pair of interconnected side frames and a rear frame defines a first opening in the top of the frame and a second opening in the front of the frame. The removable container lid closes and opens the top opening in the storage container to allow access to the storage container contents. The drawer slides in and out of the second opening to allow a second access point to the contents of the storage container.

16 Claims, 17 Drawing Sheets

U.S. PATENT DOCUMENTS

D388,957 S * 1/1998 Wolff ..... D3/323
5,816,674 A * 10/1998 Manos et al. ..... 312/290
5,904,269 A * 5/1999 Wolff ..... 220/756
5,913,580 A * 6/1999 Liu ..... 312/108
6,193,340 B1 * 2/2001 Schenker et al. ..... 312/265.5

* cited by examiner

STORAGE CONTAINER HAVING DUAL ACCESS

CROSS REFERENCE TO RELATED APPLICATIONS

This application is a non-provisional application claiming priority from U.S. Provisional Application Ser. No. 60/453,493, filed Mar. 11, 2003, entitled "File Organizers" and incorporated herein by reference.

FIELD OF THE INVENTION

The present invention generally relates to storage containers, and more particularly to a file storage container allowing access to the stored files through an extendable and retractable drawer, as well as a removable top panel.

DESCRIPTION OF THE RELATED ART

File storage containers are known for storing a wide variety of file folders. In one embodiment, file storage containers are commonly made with a frame having a sliding drawer horizontally mounted within the frame. An individual may access any files stored within the drawer only by opening the drawers. The drawer frames may sometimes be stacked one on top of the other to create a modular file container system having a plurality of horizontally accessible drawers.

In other known file storage containers, a container having a base, four side walls and an open top is arranged to allow the vertical placement of files inside the container. A removable top may be provided to cover the container. An individual may access any files stored within the container only by removing the top of the container. The containers may sometimes be stacked one on top of the other to facilitate storage, however, only the contents of the topmost container are accessible without moving the containers.

In view of the foregoing, there remains a continuing need for an improved storage container.

DETAILED DESCRIPTION OF THE DISCLOSURE

The embodiments described herein are not intended to be exhaustive or to limit the scope of the invention to the precise form or forms disclosed. Instead, the following embodiments have been described in order to best explain the principles of the invention and to enable others of ordinary skill in the art to follow its teachings.

Figure 1:
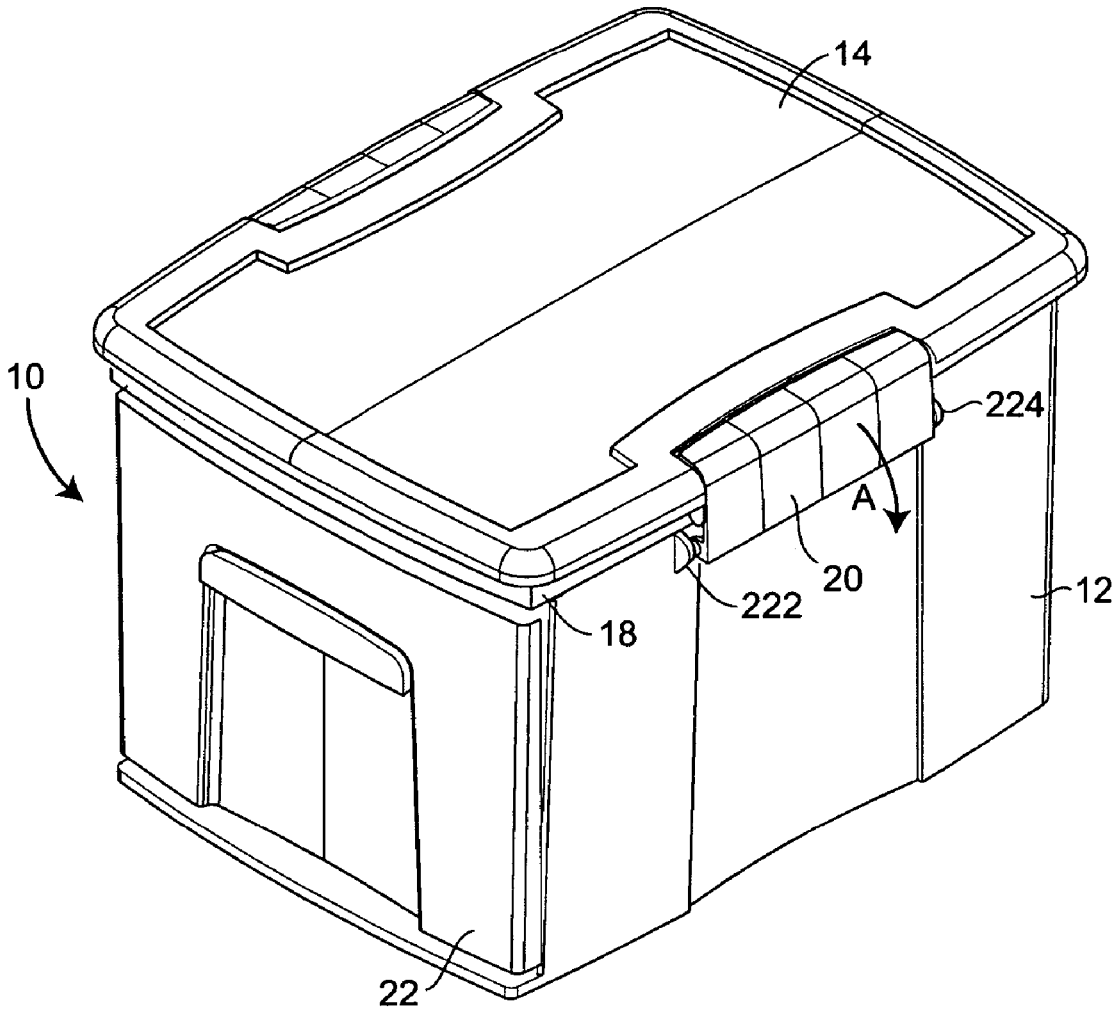
FIG. 1 is a front perspective view of one example of a storage container constructed in accordance with the teachings of the present invention.
Figure 2:
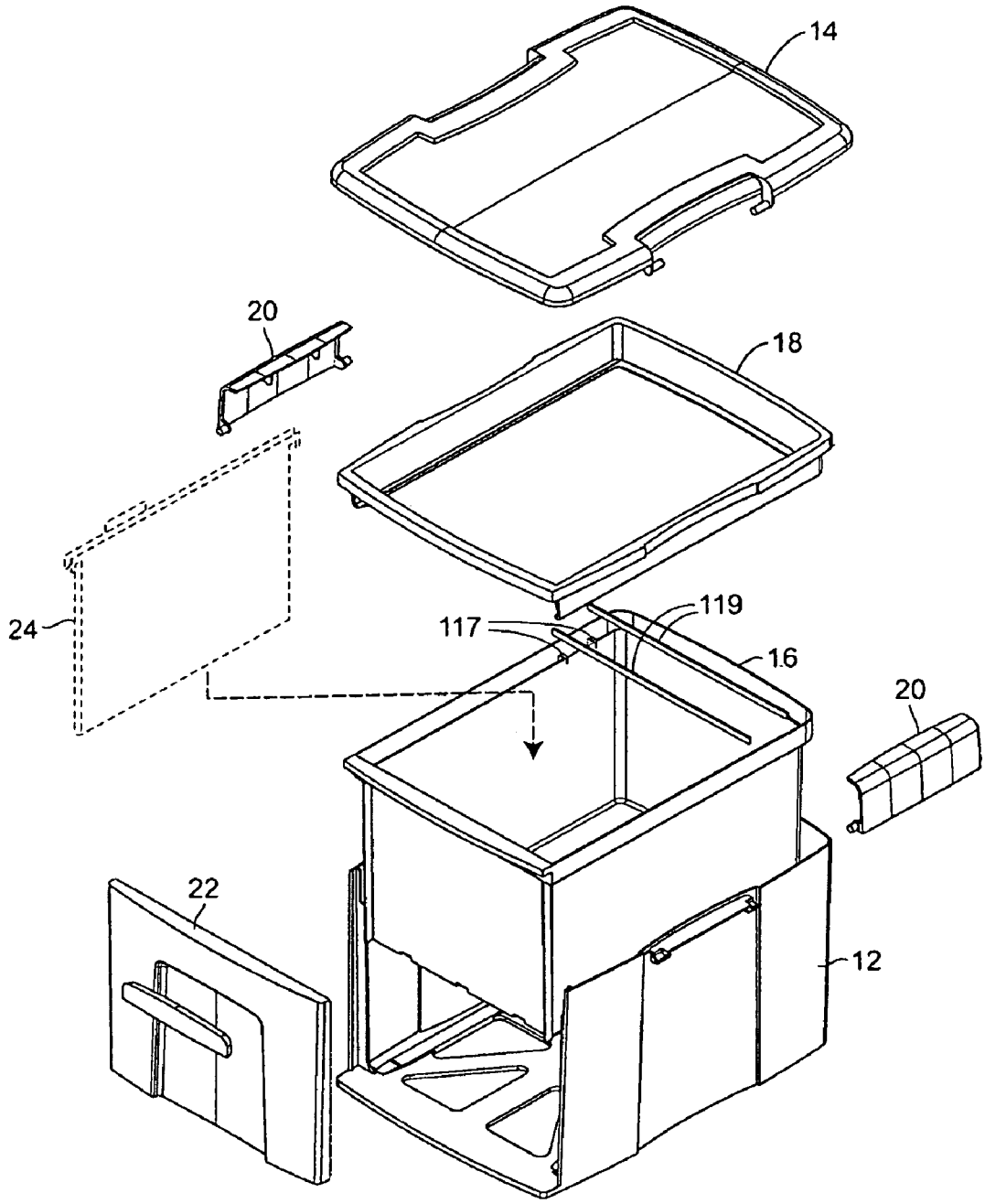
FIG. 2 is an exploded perspective view of the storage container of FIG. 1.

Turning now to the drawings, FIGS. 1-8 together illustrate one example of a storage container 10 constructed in accordance with the teachings of the present invention. With reference to FIG. 1, the container 10 generally has a storage frame 12, a container lid 14 arranged to be removably mounted on the storage frame 12, and a drawer 16 movably mounted within the storage frame 12 for movement between an open position (not shown in FIGS. 1-8) and a closed position (FIG. 1). The storage container 10 may additionally include a perimeter beam 18, a plurality of handles 20, and a drawer face 22. By way of example rather than limitation, a plurality of file folders 24 (shown in phantom in FIG. 2) can be stored in the container 10. The position, arrangement, size, variety, and quantity of the file folders can vary at any given time. Additionally, the storage container 10 may store any number of different items and may be further arranged with various attachments (described below) for storing such items.

Figure 3A:
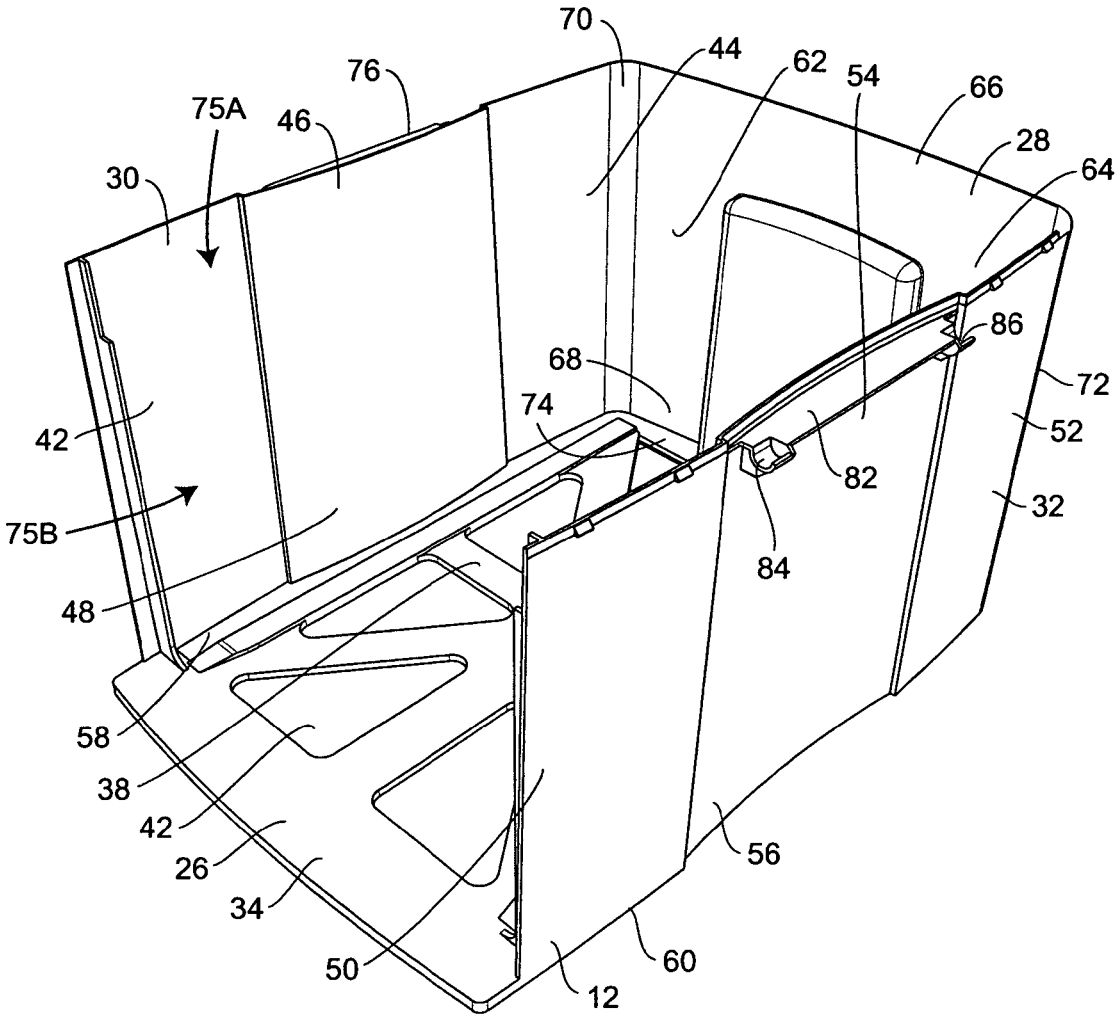
FIG. 3A is a front perspective view of one example of an assembled frame of the storage container of FIG. 1.
Figure 3B:
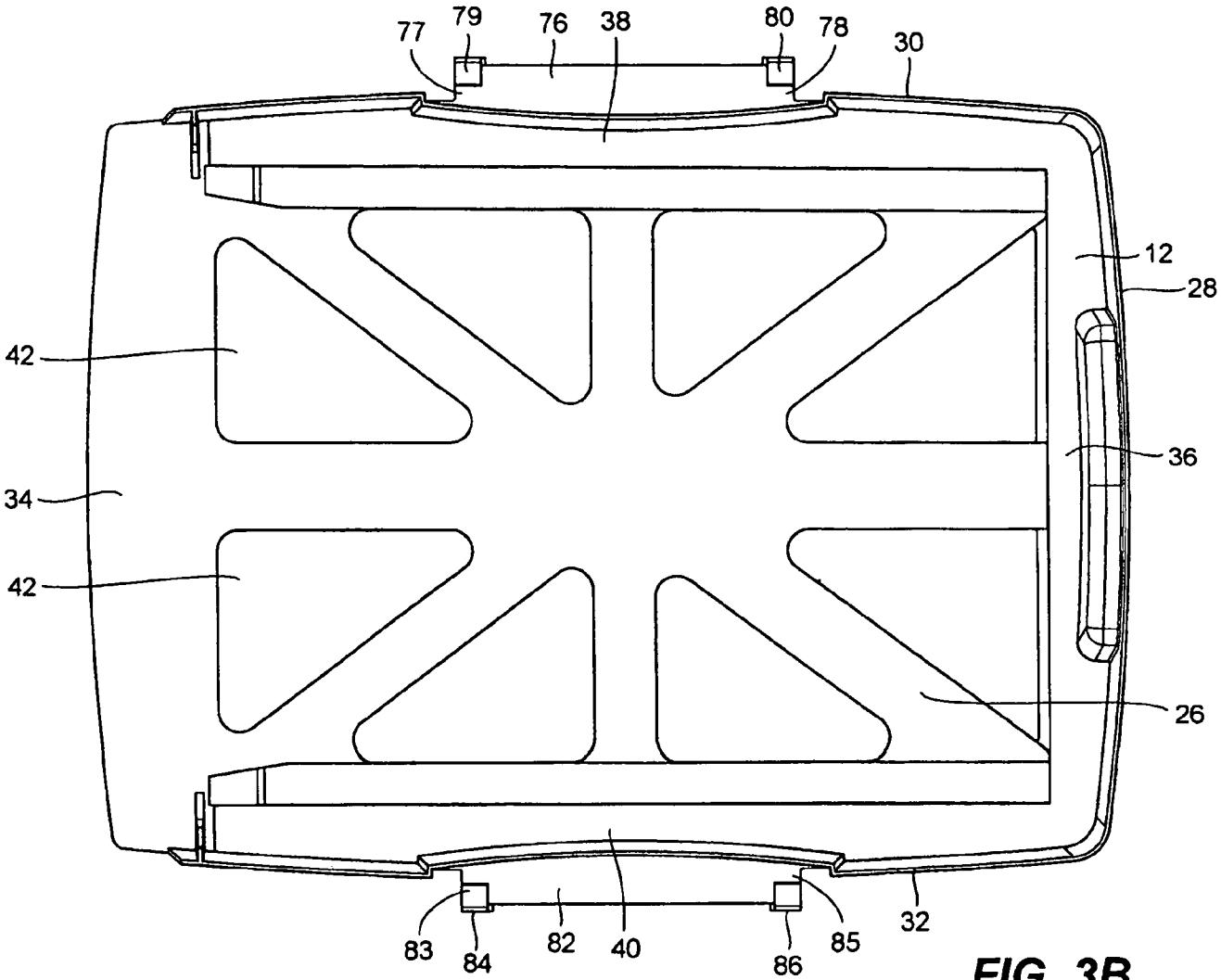
FIG. 3B is a plan view of the assembled frame of FIG. 3A.

As shown in FIGS. 3A and 3B, the storage frame 12 includes a bottom frame 26, a rear frame 28 extending from and connected to the bottom frame 26, and a pair of upstanding side frame 30, 32 extending from and connected to the rear frame 28, as well as the bottom frame 26. The bottom frame 26, the rear frame 28, and the side frames 30, 32 may each be constructed utilizing known manufacturing techniques. For example, each of the bottom frame 26, the rear frame 28, and the side frames 30, 32 may be a panel, a wire frame, a combination thereof, or any other suitable construction, as will be described below. The frames 26, 28, 30, 32 may additionally be constructed of a variety of materials including, for example, plastic (such as polyethylene, polystyrene, polypropylene, or the like), glass, metal and/or other material.

Still referring to FIGS. 3A and 3B, the bottom frame 26 may be a panel including a forward portion 34, a rearward portion 36, and pair of interconnecting side portions 38, 40. The bottom frame 26, in the disclosed example, may additionally include a plurality of apertures 42, which may reduce the weight of the bottom frame 26, while maintaining sufficient strength.

The side frame 30 of the container 10 includes a forward portion 42, a rearward portion 44, and top and bottom portions 46, 48, respectively. The side frame 32 of the container 10 includes a forward portion 50, a rearward portion 52, and top and bottom portions 54, 56, respectively. As shown in FIG. 3A, the bottom portion 48 of the side frame 30 meets the side portion 38 of the bottom frame 34 along an elongated seam 58. Similarly, the bottom portion 56 of the side frame 32 meets the side portion 40 of the bottom frame 34 along an elongated seam 60. Preferably, seams 58 and 60 are commonly formed container manufacturing seams, such as, for example, molded plastic seams, or other suitable seam.

The rear frame 28 includes a pair of side portions 62, 64 and top and bottom portions 66, 68, respectively. The side portion 62 meets the rearward portion 44 of the side frame 30 along a seam 70, while the side portion 64 meets the rearward portion 52 of the side frame 32 along a seam 72. The bottom portion 68 of the back frame 28 meets the rearward portion 36 of the bottom frame 26 along a seam 74. Again, the seams 70, 72, 74 are preferably commonly formed seams as described above.

The top portion 46 of the side frame 30, the top portion 54 of the side frame 32, and the top portion 66 of the rear frame 28 together cooperate to form a first opening 75A into a storage frame interior. Similarly, the forward portion 42 of the side frame 30, the forward portion 50 of the side frame 32, and the forward portion 34 of the bottom frame 26 cooperate to define a second opening 75B into the storage frame interior.

Extending from the top portion 46 of the side frame 30 is a projection 76. The projection 76 may be integrally formed with the side frame 30 and may extend generally perpendicular from the top portion 46. The projection 76 includes a first end 77 and a second 78 end, the first end 77 having a depression 79 formed near the first end 77, the second end 78 having a depression 80 formed near the second end 78. Each of the depressions 79, 80 form a generally arcuate half cylinder for pivotably supporting the lid 14 as will be described below.

Extending from the top portion 46 of the side frame 30 is a projection 82. The projection 82 may be integrally formed with the side frame 30 and may extend generally perpendicular from the top portion 46. The projection 82 includes a first end 83 and a second end 85, the first end 83 having a depression 84 formed near the first end 83, the second end 85 having a depression 86 formed near the second end 85. Each of the depression at 84, 86 form a generally arcuate half cylinder for pivotably supporting the lid 14 as will be described below.

Figure 4:
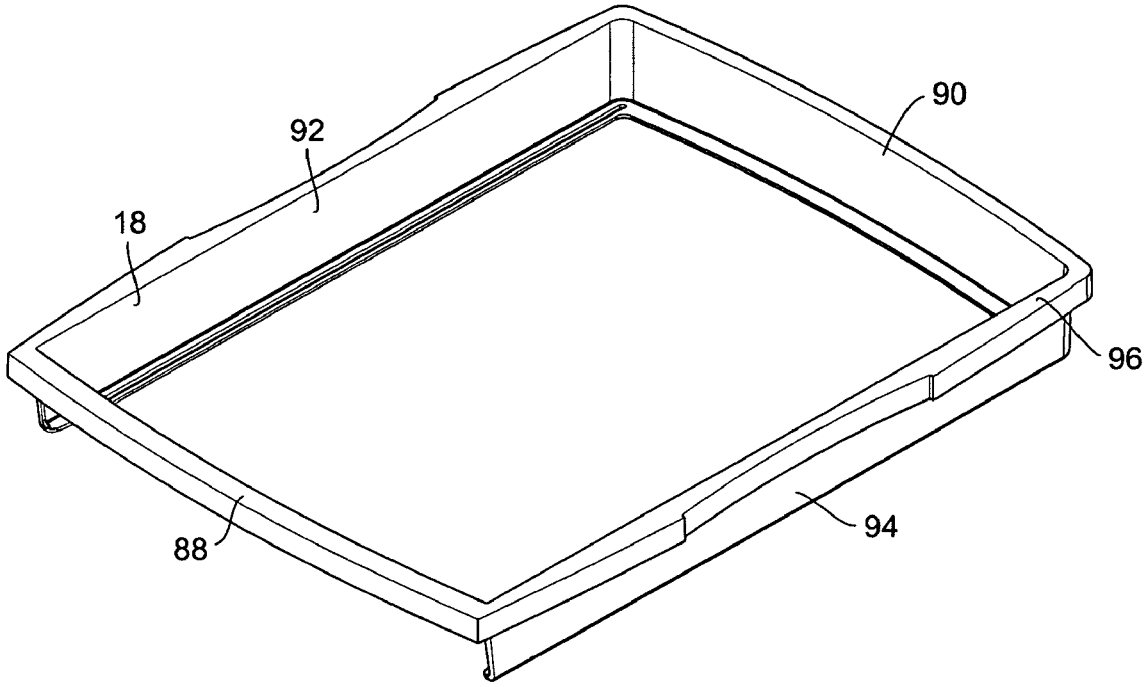
FIG. 4 is a front perspective view of one example of a support beam of the storage container of FIG. 1.

Referring now to FIG. 4, an optional perimeter beam 18 is shown which, in the illustrated embodiment is arranged to provide rigidity to the storage frame 12 as well as to further define the openings 75A and 75B. The perimeter beam 18 includes a support beam 88, a rear wall 90, and a pair of side walls 92, 94 extending between the support beam 88 and the rear wall 90. The perimeter beam 18 is arranged to be mounted on the storage frame 12 with the rear wall 90, and the side walls 92, 94 registered with the top portions 46, 54, 66 of the frames 30, 32, 28. The perimeter beam 18 includes a lip 96 which extends generally perpendicular from the perimeter beam 18 around the circumference. The lip 96 is arranged to register with the lid 14 as will be described below. The support beam 88 may provide a reinforcement for the storage frame 12 and, in the disclosed example, also forms the front portion of the opening 75A and the top portion of the opening 75B into the storage frame interior.

Figure 5A:
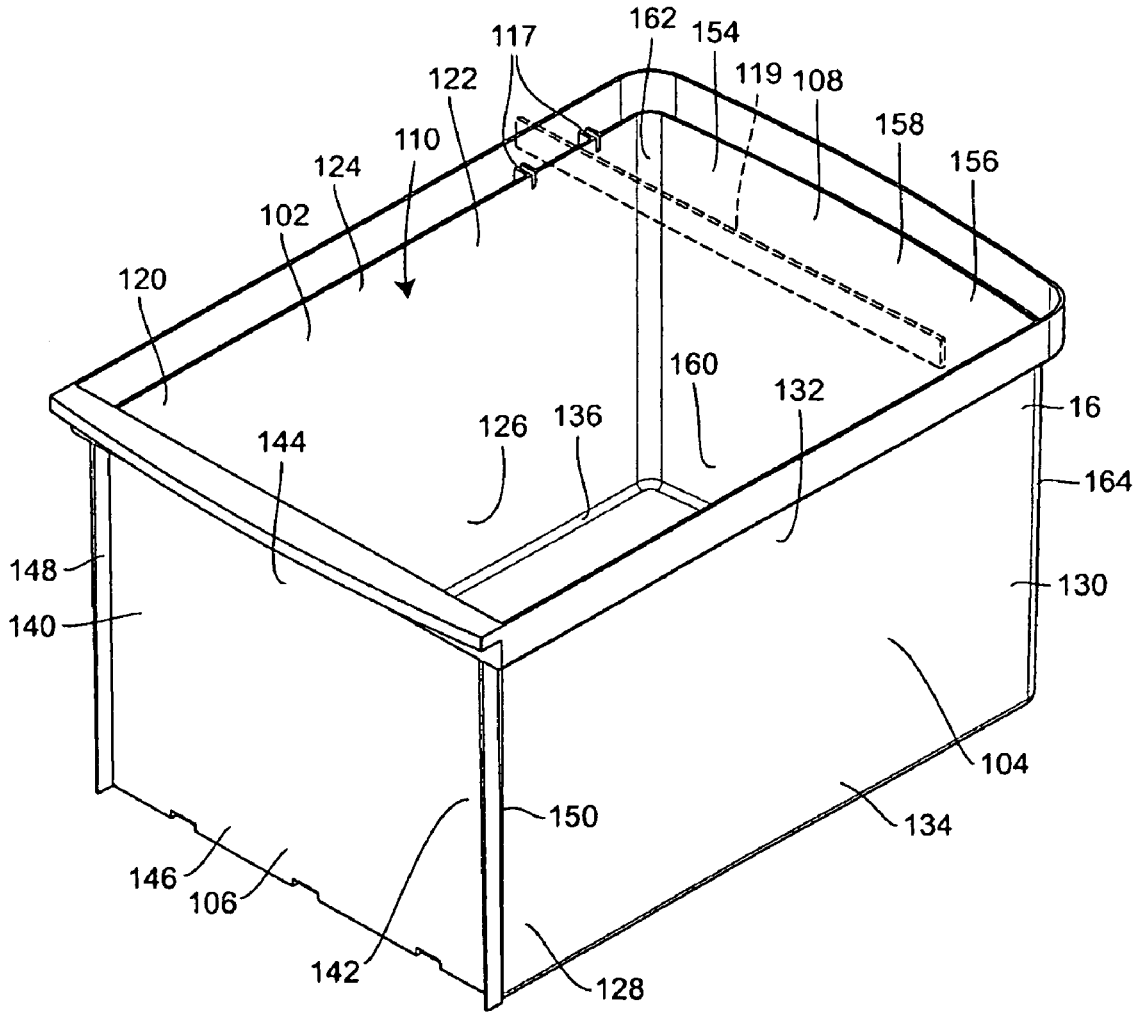
FIG. 5A is a front perspective view of one example of a drawer assembly of the storage container of FIG. 1.
Figure 5B:
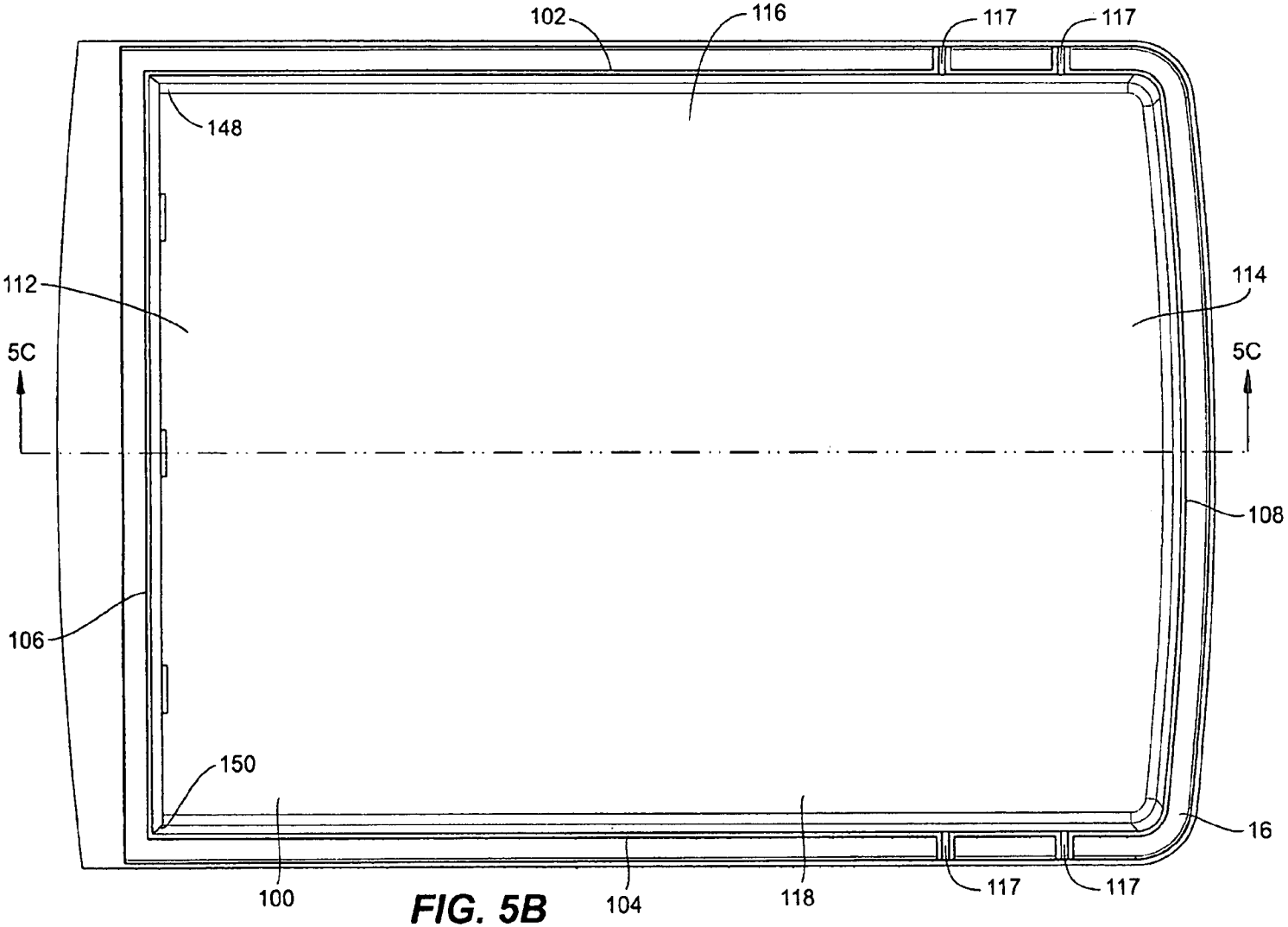
FIG. 5B is a plan view of the assembled drawer of FIG. 5A.
Figure 5C:
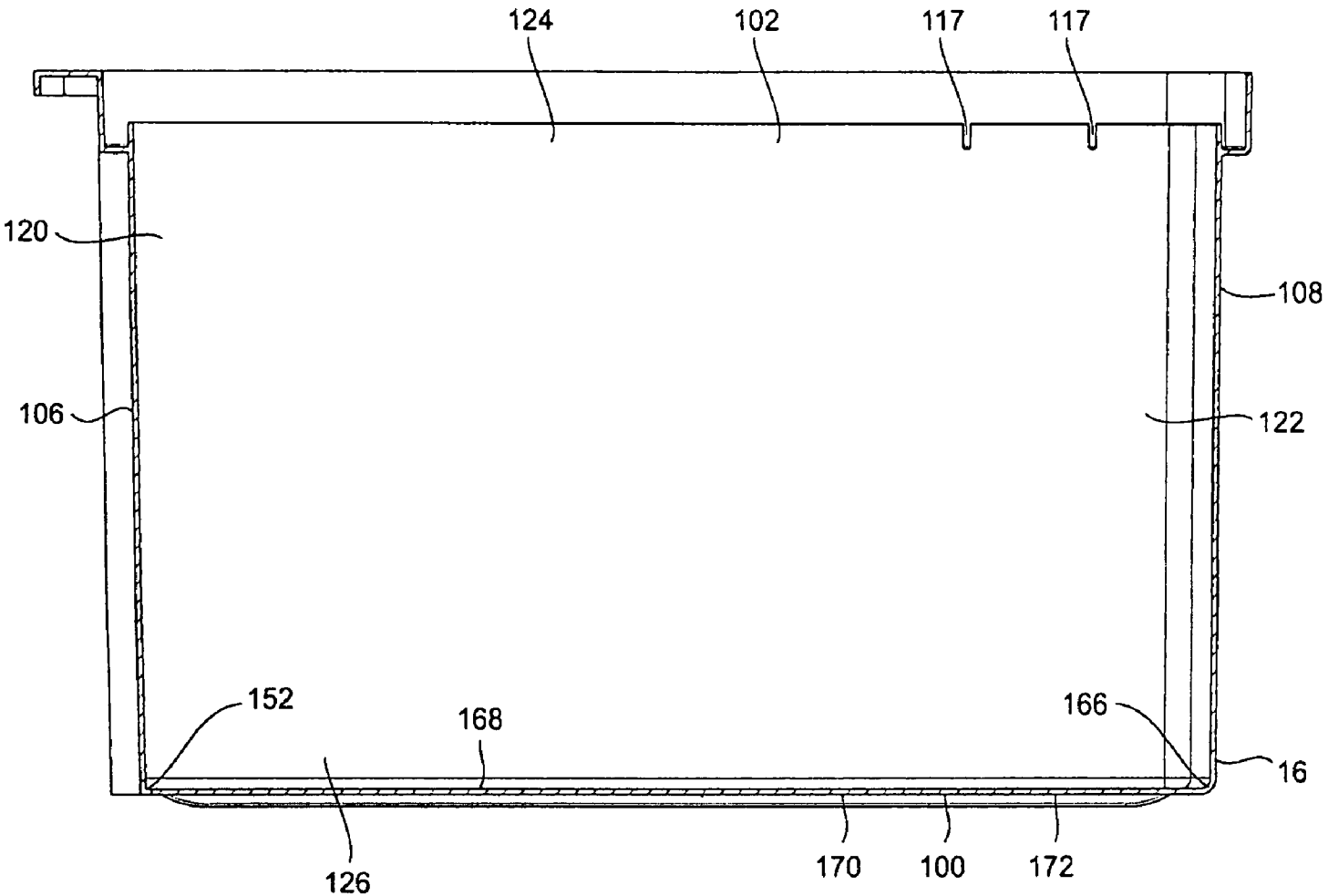
FIG. 5C is a cross section elevational view of the assembled drawer of FIG. 5A, taken along the line 5*c*-5*c* of FIG. 5B.

Turning now to FIGS. 5A-5C, an example of the drawer 16 assembled in accordance with the teachings of the embodiment of the present invention is shown. The drawer 16 generally includes a bottom panel 100, a pair of sidewalls 102, 104, a front wall 106, and a rear wall 108. The bottom panel 100, the side walls, 102, 104, the front wall 106, and the rear 108 cooperate to generally define a storage compartment 110.

The bottom panel 100 includes a forward portion 112, a rearward portion 114, and a pair of interconnecting side portions 116, 118. The side wall 102 of the drawer 16 includes a forward portion 120, a rearward portion 122, and top and bottom portions 124, 126, respectively. The side wall 104 of the drawer 16 includes a forward portion 128, a rearward portion 130, and top and bottom portions 132, 134, respectively. As shown in FIG. 5A, the bottom portion 126 of the side wall 102 meets the side portion 116 of the bottom panel 100 along an elongated seam 136. Similarly, the bottom portion 134 of the side wall 104 meets the side portion 118 of the bottom panel 100 along an elongated seam 138.

The side walls 102, 104 may also include a plurality of slots 117 which, in the disclosed example are arranged to support at least one bar 119. The bar 119, in turn, may be arranged to allow the drawer to support a variety of objects, including, for example, file folder 24, or storage compartments as illustrated below. Furthermore, the bar 119, or alternatively the slots 117 may be constructed with varying heights to allow and objects supported thereon to assume a "cascading" appearance, wherein supported objects in the rear of the drawer 16 may be spaced further away from the bottom panel 100 than objects located in the front of the drawer 16.

The front wall 106 includes a pair of side portions 140, 142 and top and bottom portions 144, 146, respectively. The side portion 140 meets the forward portion 120 of the side wall 102 along a seam 148, while the side portion 142 meets the forward portion 128 of the side wall 104 along a seam 150. The bottom portion 146 of the front wall 106 meets the forward portion 112 of the bottom panel 100 along a seam 152.

The rear wall 108 includes a pair of side portions 154, 156 and top and bottom portions 158, 160, respectively. The side portion 156 meets the rearward portion 122 of the side wall 102 along a seam 162, while the side portion 156 meets the rearward portion 130 of the side wall 104 along a seam 164. The bottom portion 160 of the rear wall 108 meets the rearward portion 114 of the bottom panel 100 along a seam 166.

The bottom panel 100 further includes a top surface 168 facing the storage compartment 110, and a bottom surface 170 opposite the top surface 168. The bottom surface 170 includes at least one rail 172 extending from the bottom surface and running generally parallel the side walls 102, 104. The rail 172 is arranged to allow the drawer 16 to slidably mount to the storage frame 12. Specifically, the drawer 16 is sized so as to be insertable through the opening 75B and into the storage frame interior with the rail 172 resting on at least a portion of the storage frame 12. The drawer 16 is therefore movably mounted within the storage frame 12 for movement between an open position (not shown in FIGS. 1-8) and a closed position (FIG. 1), wherein the drawer 16 is retracted within the storage frame interior when the drawer is in the closed position and the drawer 16 is extended from the storage frame when the drawer in the in the open position. In this way, when the drawer is in the open position, any articles within the storage compartment 110 may be accessible. It will be appreciated that a number of devices may be used to slidably mount the drawer 16 to the storage frame 12, including, for example, glides, groves, and/or the like.

Figure 6:
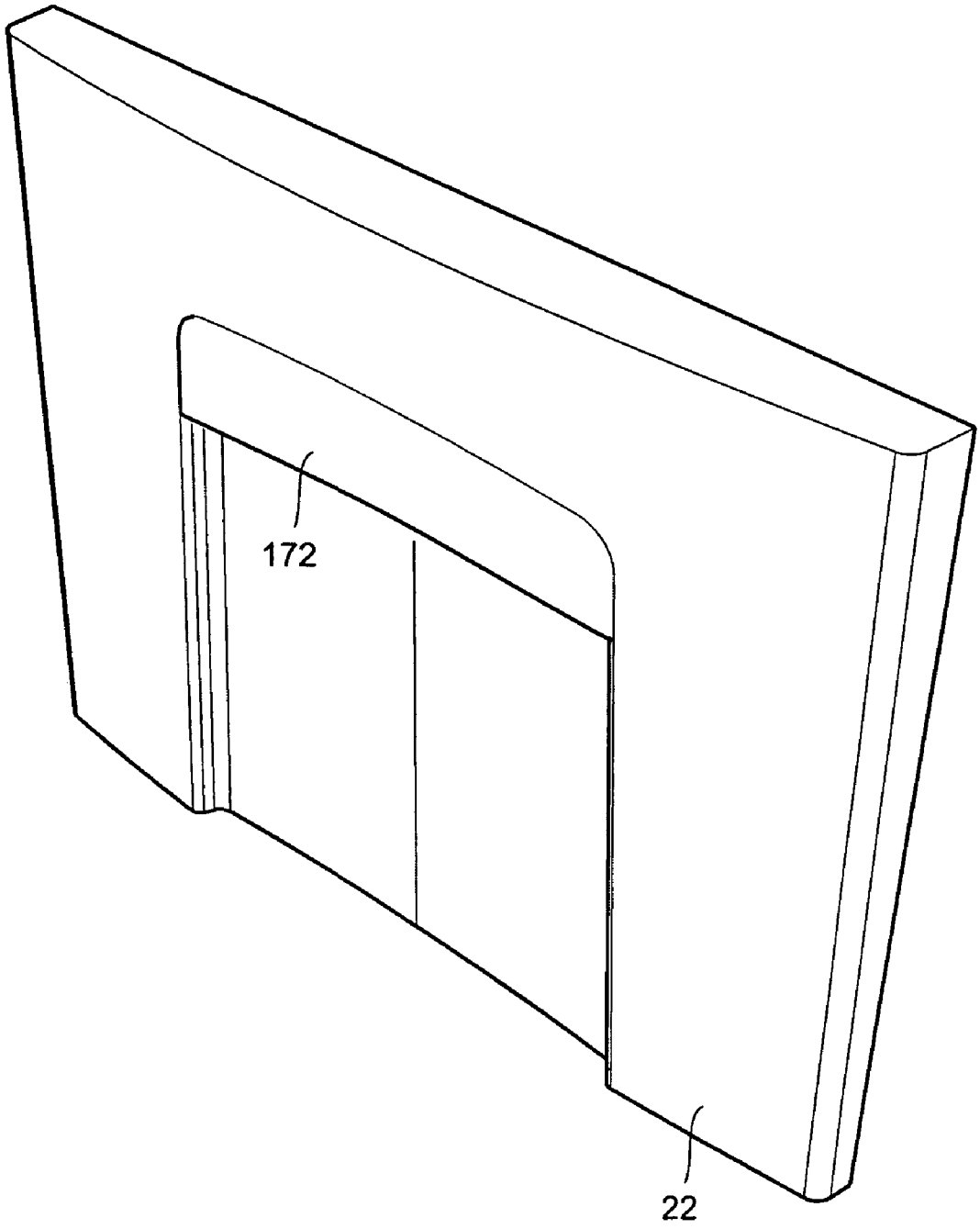
FIG. 6 is a front perspective view of one example of a drawer face of the storage container of FIG. 1.

Turning now to FIG. 6, the drawer face 22 includes a handle 172 and is attachable to the front wall 106 of the drawer 16. The drawer face 22 and the handle 172 provide a grip allowing a user to shift the drawer 16 between the first position and the second position mentioned above.

Figure 7A:
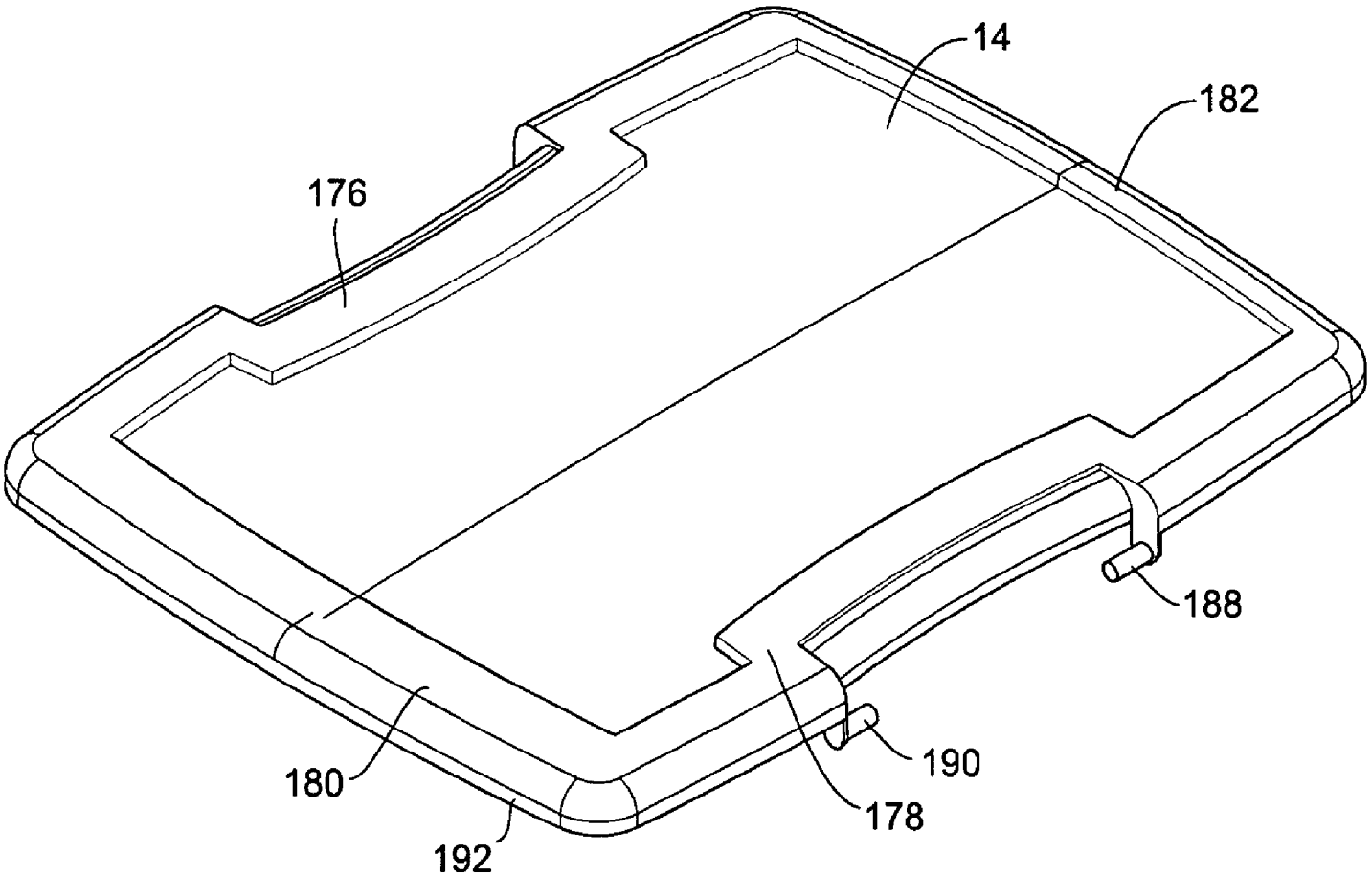
FIG. 7A is a front perspective view of one example of a lid of the storage container of FIG. 1.
Figure 7B:
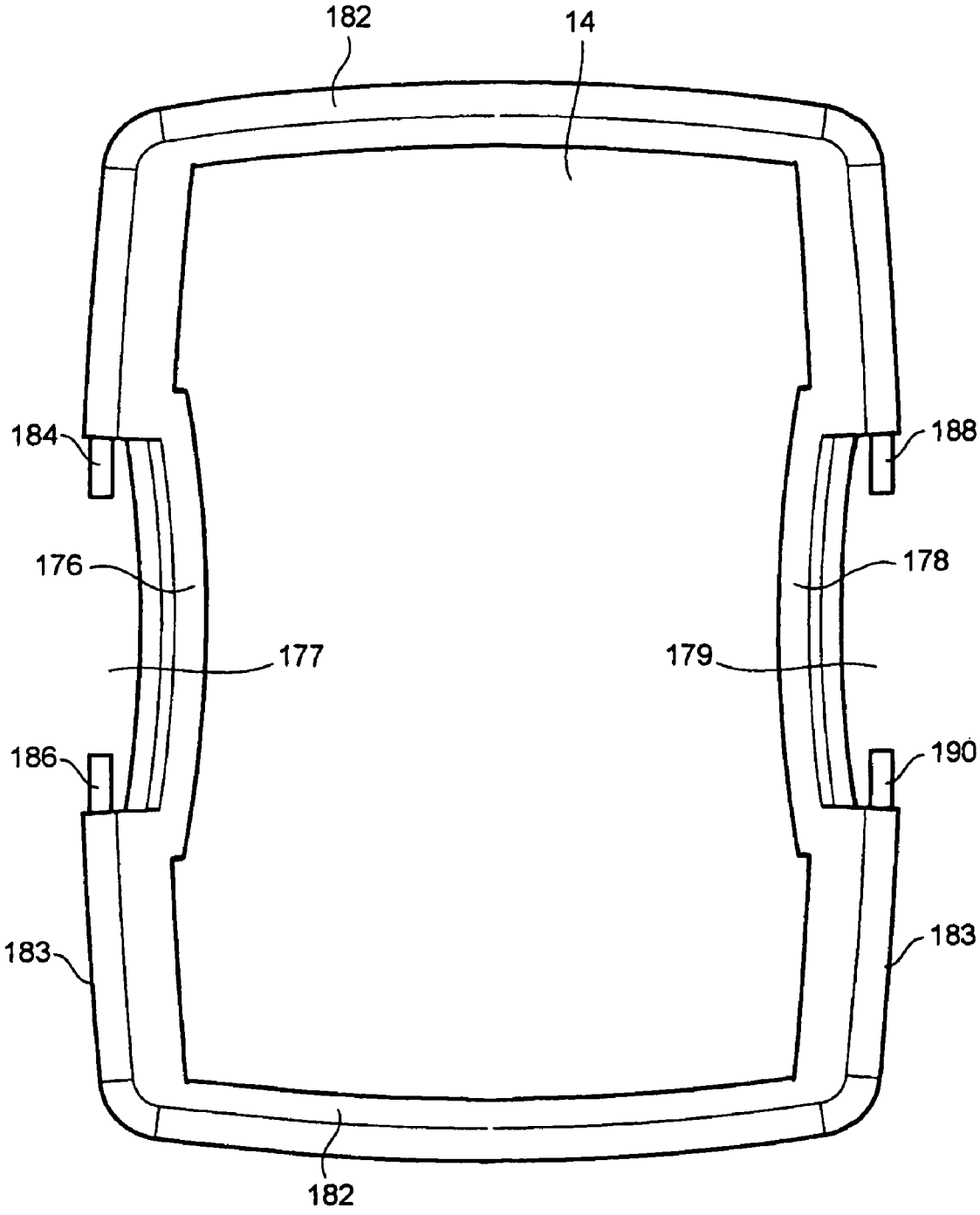
FIG. 7B is a plan view of the lid of FIG. 7A.

Referring now to FIGS. 7A and 7B, the lid 14 includes a pair of side portions 176, 178, a forward portion 180, a rearward portion 182, and a perimeter 183. The side portion 176 includes a recess 177 generally located in the center of the side portion 176 and extending inward from the perimeter 183 of the lid 14. The side portion 176 also includes a pair of pivots 184, 186 longitudinally extending from the side portion 176 into the recess 177. The side portion 178 includes a recess 179 located generally in the center of the side portion 178. The side portion 178 also includes a pair of pivots 188, 190 longitudinally extending from the side portion 178 into the recess 179. As best shown in FIG. 7A, the pivots 184, 186, 188, and 190 may be spaced apart and below the plane of the lid 14.

The lid 14 further includes a lid rim 192 which, in the disclosed example, extends downward along at least a portion of the perimeter 183 of the lid 14 and is arranged such that the lid and the lid rim may be removably mounted on the storage frame 12 with the rim registered with the top portions 46, 54, 66 of the respective side frames 30, 32 and the rear frame 28. The lid rim 192 may additionally register with the perimeter beam 88 if the support beam 88 is optionally attached to the container 10.

When the lid 14 is in the closed position illustrated in FIG. 1, the side portion 176 meets the top portion 46 of the side frame 30, the side portion 178 meets the top portion 54 of the side frame 32, the rear portion 182 meets the top portion 66 of the rear frame 28, and the forward portion 180 meets the perimeter beam 88 (if provided) to close the opening 75A into the storage frame interior.

When the lid 14 is registered with the storage frame 12, the pivots 184, 186 are nested within the depressions 78 and 80 of the side frame 30, forming a hinge line about which the top may be pivotable as described below. Additionally, when the lid 14 is registered with the storage frame 12, the pivots 188, 190 are nested within the depressions 84, 86 to form a second hinge line about which the lid 14 may be pivotable as described in greater detail below.

Figure 8:
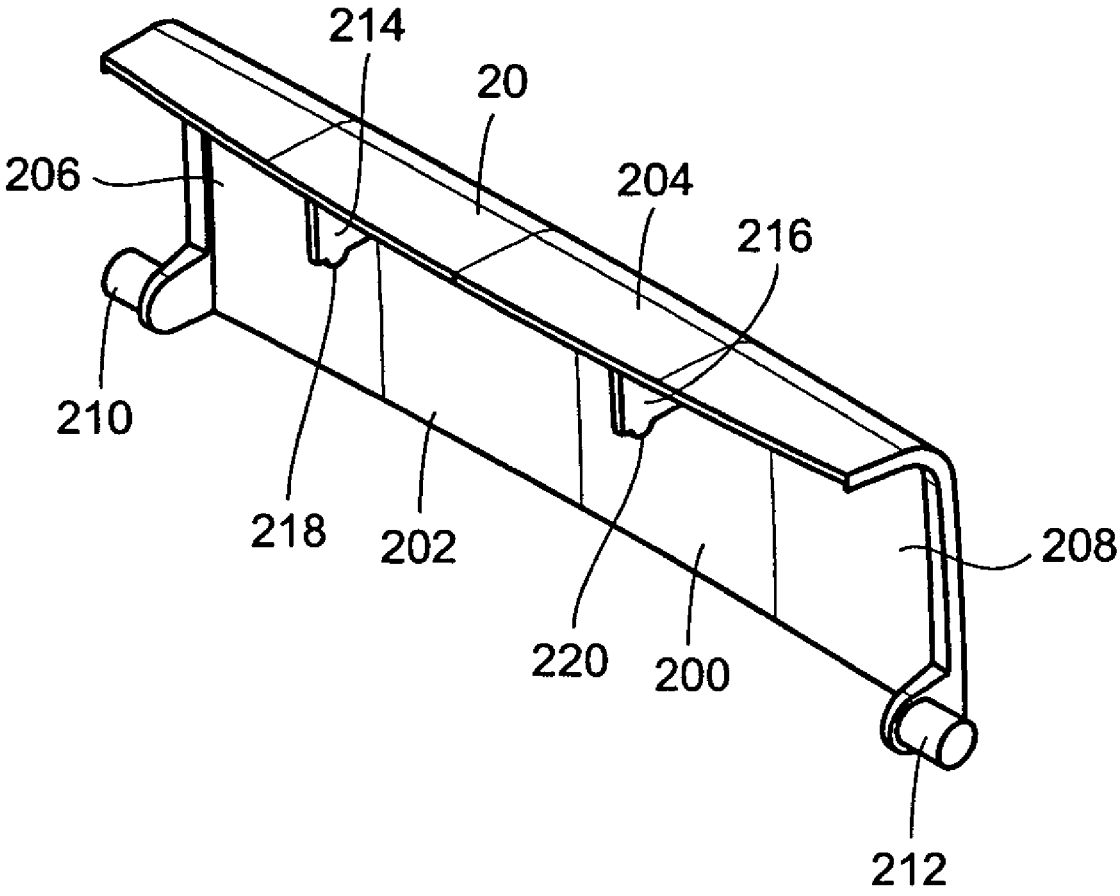
FIG. 8 is a rear perspective view of one example of a handle of the storage container of FIG. 1.

Turning now to FIG. 8, an embodiment of one of the handles 20 as assembled in accordance with teachings of the present invention is shown. The handle 20 includes a generally L-shaped handle wall 200 having a bottom portion 202 and a top portion 204 bent at approximately 90 degrees from the plane of the handle wall 200. The handle wall 200 further includes a pair of side portions 206, 208. Extending outwardly from the handle 20 near the bottom portion 202 is a pair of pivots 210, 212. The handle 20 further includes a pair of tabs 214, 216 extending generally perpendicular and downward from the top portion 204 of the handle wall 200. The tabs 214, 216 may intersect the handle wall 200 and may be attached generally perpendicular to the handle wall 200. Each of the tabs 214, 216 includes a detent 218, 220 extending from the bottom surface of the tabs 214, 216.

Referring again to FIG. 1, each of the handles 20 are pivotably mounted to the side frames 30, 32, respectively. Specifically, the pivots 210, 212 on one of the handles 20 are pivotably mounted to the pivot retainers 222, 224. Each of the pivot retainers 222, 224 may be integrally formed with and/or extending from the side frame 32 to retain the pivots 210, 212 and allow for the downward rotation of the handle 20 in the direction of the arrow A.

Similarly, the second handle 20 may be pivotably mounted to the side frame 30 by the insertion of the pivots 210, 212 and two pivot retainers (not shown). The handle 20 mounted to the side frame 30 may also pivot downward about the pivots 210, 212. It will be appreciated that the handles may be pivotable attached to the side frames 30, 32 in a variety of different ways as may be known or later developed.

In operation, each of the handles 20 is pivotable between a first position as shown in FIG. 1 and a second position (not shown) wherein the handle is pivoted away from the lid 14 in the direction of the arrow A. When the handle 20 is in the first position as shown in FIG. 1, the top portion 204 latchably engages the lid 14 at the recess 179. Specifically, the detents 218, 220 on the tabs 214, 216, respectively may nest within notches formed in the lid rim 192. Alternatively, the detents 218, 220 on the tabs 214, 216, respectively, may nest within notches formed on the projection 82 (not shown). Additionally, the tabs 214, 216 may retain the pivots 188, 190 within the depressions 84, 86 on the projection 82.

In similar fashion the other handle 20 may be shiftably mounted to the side frame 30 for movement between a first position and a second position wherein the handle is pivoted away from the lid 14. When the other handle 20 is in the first position as shown in FIG. 1, the top portion 204 latchably engages the lid 14 at the recess 177. Specifically, the detents 218, 220 on the tabs 214, 216, respectively may nest within notches formed in the lid rim 192. Alternatively, the detents 218, 220 on the tabs 214, 216, respectively, may nest within notches formed on the projection 76 (not shown). Additionally, the tabs 188, 190 may retain the pivots 184, 186 within the depressions 79, 80 on the projection 76.

While each of the pivot axis in the disclosed embodiment may be fixed relative the storage frame 12, it is understood that a complex movement, for example, translation and rotation, may be provided for by a complex pivot arrangement such as, for example, a four-bar mechanism.

To open the lid 14 in a first direction, the handle 20 pivotably mounted to the side frame 30 may be shifted towards the second position thereby releasing the lid 14. While the handle attached to the side frame 30 is in the second position, the handle 20 attached to the side frame 32 may be retained in the first position thereby form allowing the pivots 188, 190 and the depressions 84, 86 to a hinge line about which the lid 14 may pivot such that the contents of the storage frame interior may be accessible through the opening 75A. In a second operating position, the handle 20 mounted to the side frame 32 may be shifted from the first position to the second position thereby releasing the pivots 188, 190 while the handle 20 mounted to the side frame 30 may be shifted towards the first position thereby retaining the pivots 184, 186 within depressions 78, 80, and forming a hinge line about which the lid 14 may rotate up and away from the storage frame 32 allowing any contents of the storage frame interior to be accessible through the opening 75A. In a third operating position, both handles 20 may be rotated towards their respective second positions thereby releasing all four pivots 184, 186, 188, 190 and allowing the lid 14 to be completely removed from the storage frame 12 and allowing access to the contents of the storage frame interior through the opening 75A. In a final operating position, both the handles 20 may be rotated towards their respective first positions thereby retaining the lid 14 on the storage frame 12 and preventing access to the storage frame interior through the opening 75A.

In this manner, the disclosed storage container 10 has a storage interior that can be accessed either by lifting the lid 14 or by sliding the drawer 16 out horizontally. The container 10 can be used for general storage and/or file storage, and can accommodate hanging file folders, envelopes, standard folders, and the like. The container may be optionally fitted with casters as is known in the art to accommodate portability. The container may have adjustable/removable dividers for instant and selectable segmentation. Several optional features that provide easy access and readability may include, but are not limited to, a cascading file storage means and clear panels (such as a clear lid or side panels) enabling consumers to see the containers contents without opening the lid or the drawer.

Figure 9:
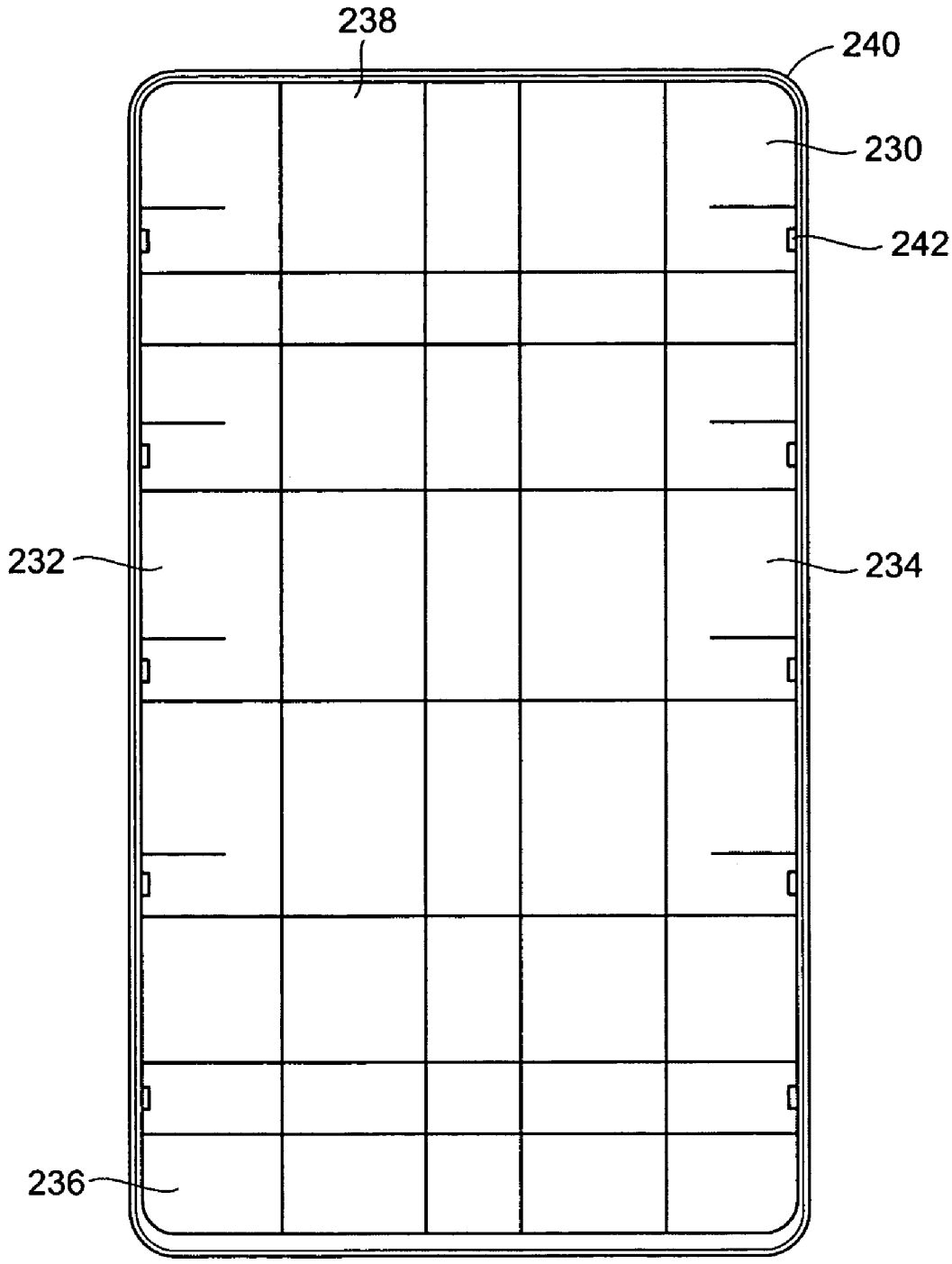
FIG. 9 is a plan view of an alternative example of a lid of the storage container similar to that shown in FIG. 1.

Turning now to FIG. 9, an alternative embodiment of the lid 14 is shown and is generally referred to as referenced numeral 230. The lid 230 includes a pair of side portions 232, 234, a forward portion 236, and rearward portion 238. The lid 230 further includes a lid rim 240 which extends along at least a portion of the perimeter of the lid 230. At various locations along at least a portion of the lid rim 240 are a plurality of detents 242 which extend generally perpendicular and inwardly from the lid rim 240. The detents 242 are arranged such that the lid 238 and the lid rim 240 may be removably mounted on the storage frame 12 with the detents 242 registered with the top portions 246, 54, 66 of the respective side frames 30, 32, and the rear frame 28. Alternatively, the detents 242 may be removably mounted on the storage frame 12 with the detents 242 registered with the perimeter beam 18.

It will be appreciated that while the alternative embodiment of the lid 238 may be removed from the storage frame 12 thereby permitting access to the storage container 10 through the opening 75A, the lid 238 may not be pivotable in the same fashion as lid 14. It will further be appreciated that the lid 238 may be arranged such that one side portion is pivotably attached to the storage frame 12 for pivoting about a single permanent or temporary hinge line.

Figure 10A:
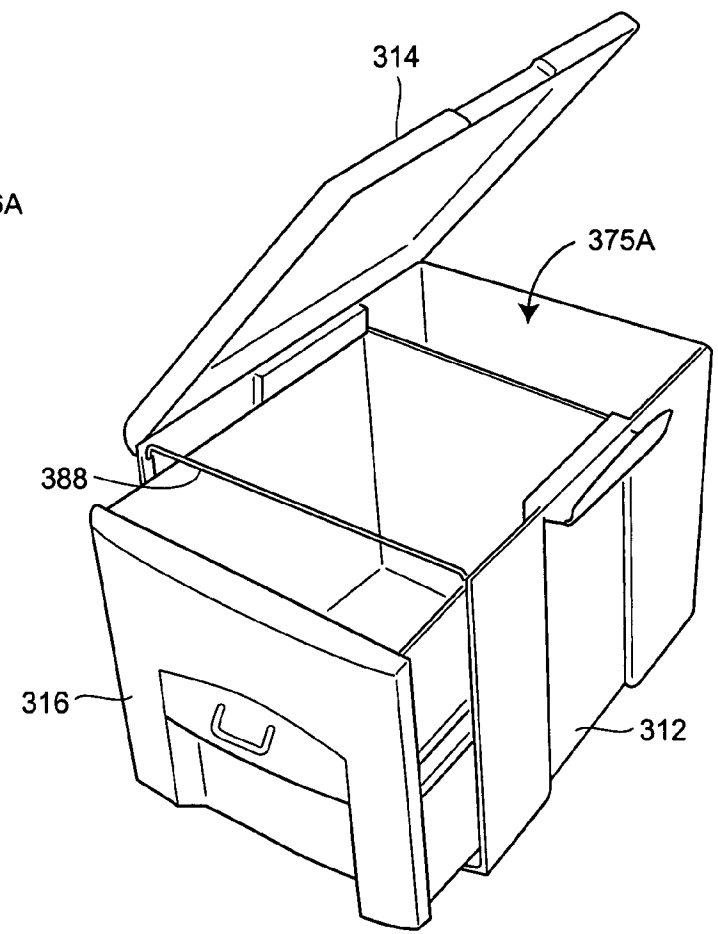
FIG. 10A is a front perspective view of an alternative example of a storage container constructed in accordance with the teachings of the present invention.
Figure 10B:
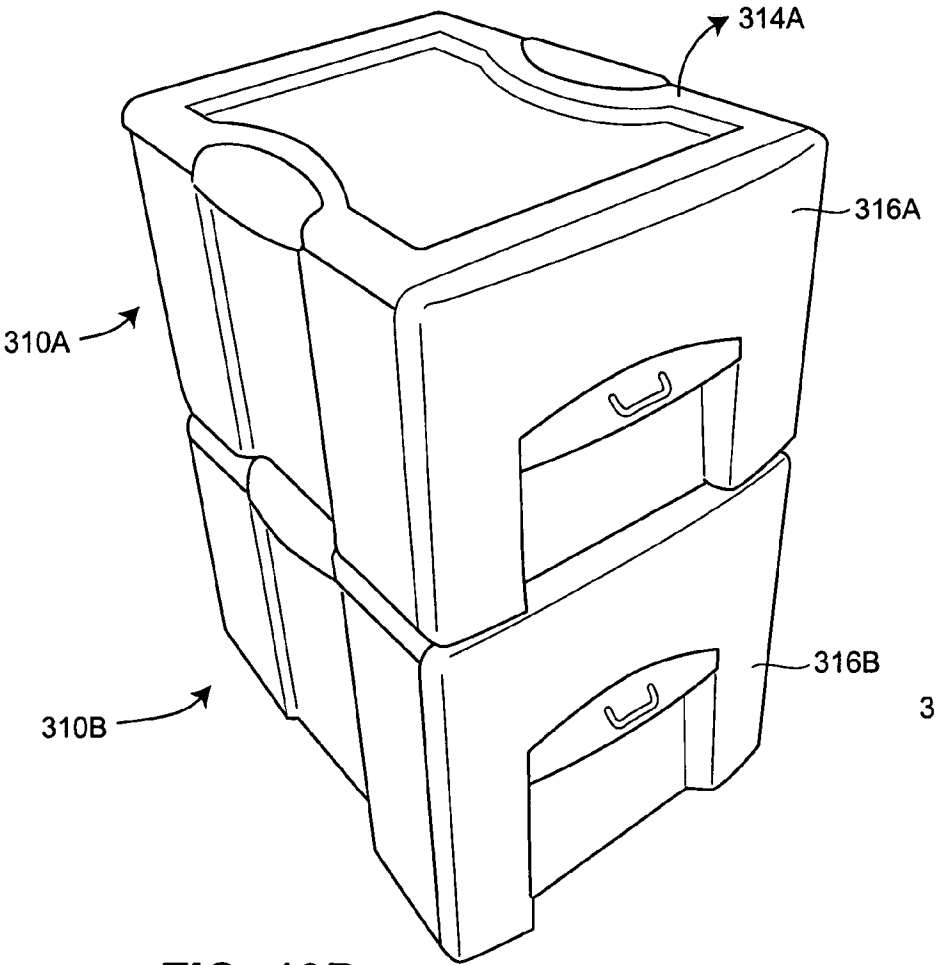
FIG. 10B is a front perspective view of the storage container of FIG. 10A showing a plurality of stacked containers.

Referring now to FIGS. 10A and 10B, another example of a storage container 310 constructed in accordance with the teachings of the present invention is shown. The container 310 generally has a storage frame 312, a container lid 314 arranged to be removably mounted on the storage frame 312, and a drawer 316 movably mounted within the storage frame 312 for movement between an open position (FIG. 10A) and a closed position (FIG. 10B).

Similar to the first example, the container 310 may be constructed of a plurality of panels including, a bottom panel (not visible in the drawings), a upstanding rear panel, and a pair of side panels. In the illustrated example, however, the container 310 includes an independent support beam 388 which in the illustrate example extends between the side panels to provide a reinforcement for the storage frame 312, forming a front portion of a first opening 375A, and forming the top portion of a second opening 375B.

As shown in FIG. 10B, a first storage container 310A is stacked above and stored upon a second storage container 310B. In the illustrated arrangement, contents of the interior of the second storage container 310B may be accessible by opening the second drawer 316B as described above. Meanwhile, the contents of the first storage container 310A may be accessible by either opening the drawer 316A, or by opening the lid 314A as described in conjunction with the previous example.

Figure 11B:
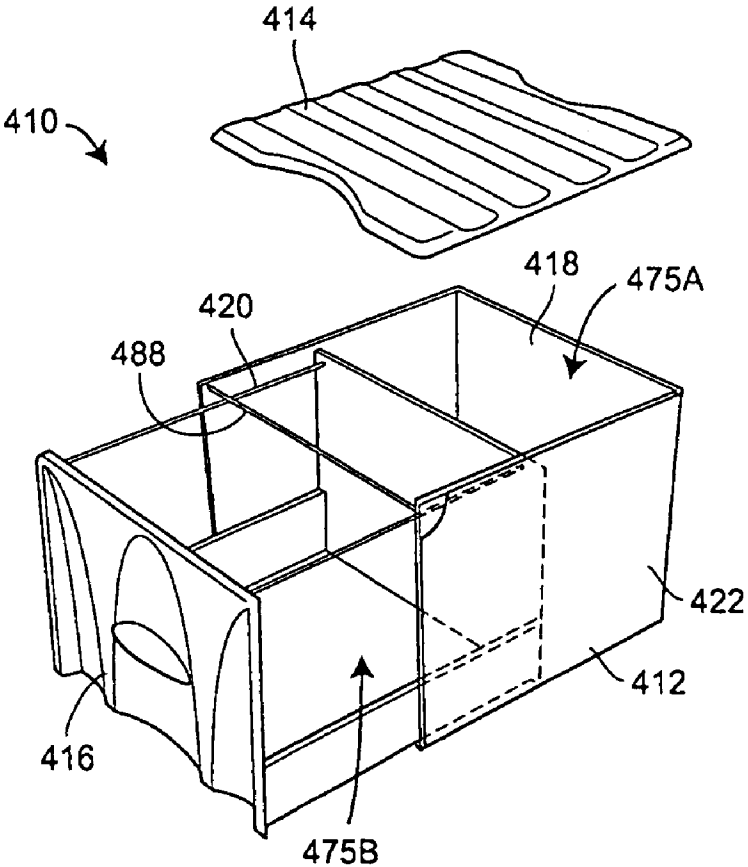
FIG. 11B is a partially exploded front perspective view of the storage container of FIG. 11A showing a removable lid and an extendable drawer assembly.
Figure 11A:
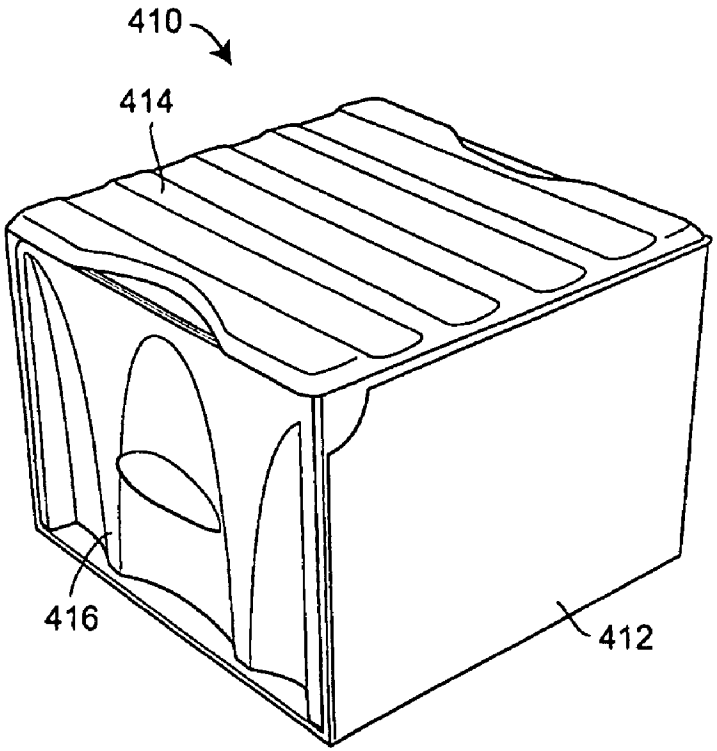
FIG. 11A is a front perspective view of an alternative example of a storage container constructed in accordance with the teachings of the present invention.

Referring now to FIGS. 11A and 11B, another example of a storage container 410 constructed with the teachings of the present invention is shown. The container 410 generally has a storage frame 412, a container lid 414 arranged to be removably mounted on the storage frame 412, and a drawer 416 moveably mounted within the storage frame 412 for movement between an open position (FIG. 11B) and a closed position (FIG. 11A). Similar to the previous examples, the storage frame 412 may be constructed of a plurality of panels, notably a bottom panel (not visible in the drawings), a rear panel 418, and a pair of side panels 420, 422. The storage frame may further include a support beam 488, which in the disclosed example, provides reinforcement for the storage frame 412 and forms the front portion of an opening 475A into the storage frame interior.

In the illustrated example, the lid 414 may be similar to the lid as described in conjunction with FIG. 9, in that the lid may form the top portion of the storage frame 12 thereby closing the opening 475A when the top 414 is in the closed position (FIG. 11A). The top 414 may allow access to the storage frame interior through the opening 475A when the lid 414 is in the open position (FIG. 11B). In the illustrated example of FIGS. 11A, 11B, the lid 414 is not arranged to be pivotable relative the storage frame 412.

Figure 12B:
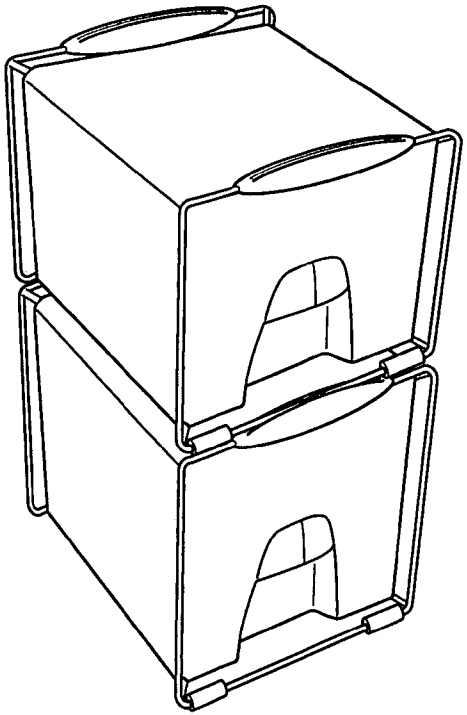
FIG. 12B is a front perspective view of the storage container of FIG. 12A showing a plurality of stacked containers.
Figure 12C:
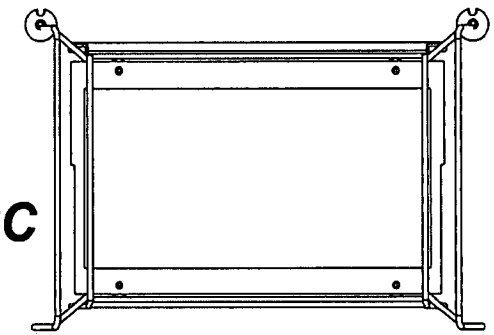
FIG. 12C is a right elevational view of the storage container of FIG. 12A.
Figure 12A:
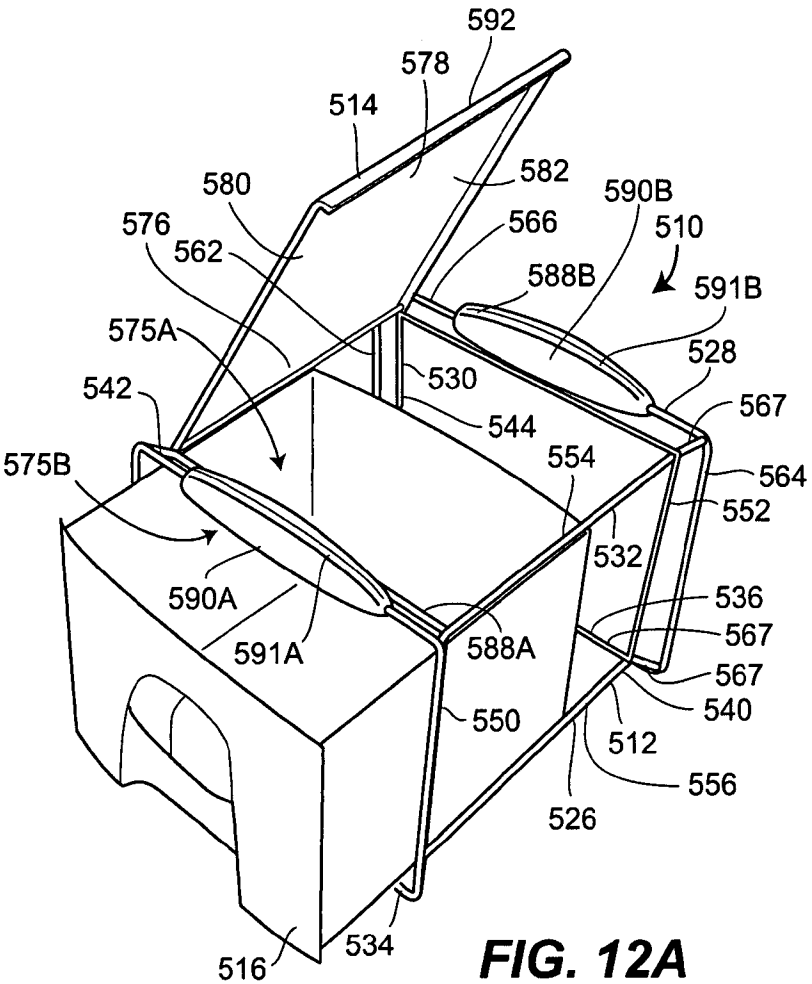
FIG. 12A is a front perspective view of an alternative example of a storage container constructed in accordance with the teachings of the present invention.

Referring now to FIGS. 12A, 12B and 12C, yet another example of a storage container 510 constructed in accordance with the teachings of the present invention is shown. The container 510 is similar to the container 10 as described above, in that the container 510 generally has a storage frame 512, a container lid 514 arranged to be removably mounted on the storage frame 512, and a drawer 516 movably mounted within the storage frame 512 for movement between an open position (FIG. 12A) and a closed position (FIG. 12B). The storage frame 512 includes a bottom frame 526, a rear frame 528, a front frame 529, each of the rear frame 528 and the front frame 529 extending from and connected to the bottom frame 526, and a pair of upstanding side frames 530, 532 extending from and connected to the rear frame 528, the front frame 529, as well as the bottom frame 526.

The bottom frame 526, the rear frame 528, the front frame 529, and the side frames 530, 532 are each constructed utilizing known manufacturing techniques, and may be, such as illustrated, a wire frame. Specifically, the bottom frame 526, may be a wire frame including a front rod 534, a rear rod 536, and a pair of interconnecting side rods 538 (not visible) and 540. The bottom frame 526 may, in the disclosed example, be generally rectangularly shaped.

The side frame 532 includes a front rod 550, a rear rod 552, and top and bottom rods 554, 556, respectively. As can be seen by the illustration, the bottom rod 556 of the side frame 532 may be integrally formed with and/or the same rod as the side rod 540 of the bottom frame 526. Similarly, while not completely visible in the illustrated embodiment, the side frame 530 of the container 510 includes a front rod 542, a rear rod 544, and a top and bottom rods 546, 548, (not visible) respectively. It will further be appreciated, that the bottom rod 548 of the side frame 530 may be integrally formed with and/or the same rod as the side rod 538 of the bottom frame 526.

The rear frame 528 includes a pair of side rods 562, 564 and top and bottom rods 566, 568, respectively. The side rod 562 meets and may be integrally formed with and/or the same rod as the rear rod 544 of the side frame 530, while the side rod 564 meets and may be integrally formed with and/or the same rod as the rear rod 552 of the side frame 532. The bottom rod 568 of the rear frame 528 meets and may be integrally formed with and/or the same rod as the rear rod 536 of the bottom frame 526.

The front frame 529 includes a pair of side rods 561, 565 and top and bottom rods 567, 569, respectively. The side rod 561 meets and may be integrally formed with and/or the same rod as the front rod 542 of the side frame 530, while the side rod 565 meets and may be integrally formed with and/or the same rod as the front rod 550 of the side frame 532. The bottom rod 569 of the front frame 529 meets and may be integrally formed with and/or the same rod as the front rod 534 of the bottom frame 526.

It will be understood that in the illustrated embodiment, the rods of the front frame 529 and the rear frame 528 are spaced away from the rods of the side frame 530, 532 and the bottom frame 526 via a plurality of spacer rods 567. It will be further appreciated that a variety of rod configurations may be designed.

Extending between the top rods 554, 546 are a pair of support beams 588A, 588B. The top rod 546 of the side frame 530, the top rod 554 of the side frame 532, and the support beams 588A, 588B together cooperate to form an opening 575A into the storage frame interior. Similarly, the forward rod 542 of the side frame 530, the forward rod 550 of the side frame 532, the forward portion 534 of the bottom frame 526 and the support beam 588A cooperate to define an opening 575B into the storage frame interior.

Mounted on the top rod 567 of the front frame 529 is a handle 590A. The handle 590A may be integrally formed with the top rod 567 or may, as in the illustrated example, be mounted on the rod 567. The handle 590A may include a lateral grove 591A located above the top rod 567 of the front frame 529. Similarly, the top rod 566 of the rear frame 528 includes a handle 590B having a lateral grove 591B located above the top rod 566. Together, the handles 590A and 590B are arranged to allow a user to lift the storage container 512. Similarly, the lateral groves 591A and 591B are arranged such that the container 512 may be nestably stacked one on top of another as shown in FIG. 12B.

The container 512 also includes a drawer 516 shiftably mounted within the container 512 and constructed similar to the examples of FIGS. 5A-5C and described therein.

The lid 514 includes a pair of side portions 576, 578, a forward portion 580, and rearward portion 582. Each of the portions 176, 178, 180, 182 of the lid 14 may include a lid rim 592 which extends along at least a portion of the perimeters of the lid 514 and is arranged such that the lid 514 and the lid 592 may be removably mounted on the storage frame 12 with the rim 592 registered with the top rods 546, 554, and the support beams 588A, 588B. The lid rim 592 may have a generally arcuate shape such that the lid 514 may pivot about any of the top rods 546, 554, and the support beams 588A, 588B.

When the lid 514 is in the closed position illustrated in FIG. 12B, the side portion 576 meets the top rod 546 of the side frame 530, the side portion 578 meets the top rod 554 of the side frame 532, the rear portion 582 meets the support beam 588B, and the forward portion 580 meets the support beam 588A to close the opening 575A into the storage frame interior. When the lid 514 is removed from the storage frame 12, the contents of the storage frame interior may be accessible through the opening 575A.

Figure 13:
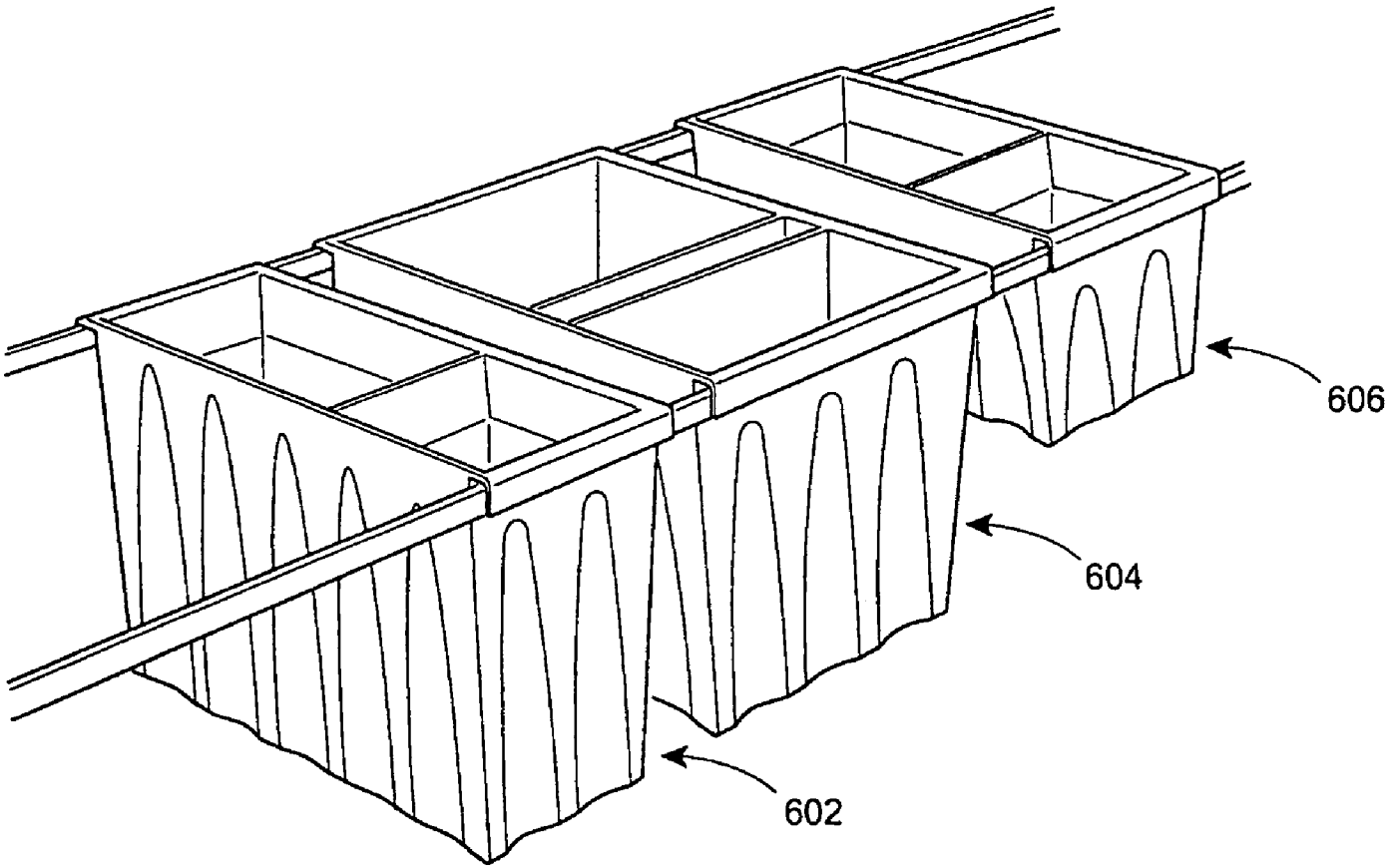
FIG. 13 is a front perspective view of a plurality of hanging baskets which may be used in conjunction with a storage container assembled in accordance with the teachings of the present invention.

Referring now to FIG. 13, an example of a variety of storage accessories in the form of containers 602, 604, 606 are shown. In the illustrated example, each of the containers may be supported by any of the drawers (e.g. drawer 16) of the previously described examples. As shown, the containers 602, 604, and 606 of various sizes and shapes may be supported by a plurality of the bars 117 to offer easy access to a variety of small to large items. It will be appreciated that the containers 602, 604, 606 may be supported directly by the drawer 16, or other similar support mechanism, including a bar which may cause the container 602, 604, 606 to cascade towards the drawer front.

Although particular examples of a storage container with dual access rack has been disclosed and described herein in accordance with the teachings of the present invention, the scope of coverage of this patent is not limited thereto. On the contrary, this patent covers all embodiments of the teachings of the invention that fairly fall within the scope of permissible equivalents.

What is claimed is:

1. A storage container comprising:

a storage frame having a bottom frame and a plurality of interconnected side frames extending from and connected to the bottom frame, the side frames terminating at a top end that defines an opening into a storage frame interior;

a container lid having a lid rim, the container lid including a pivot extending from a side portion of the container lid, the pivot adapted to nest in a depression formed in at least one of the side frames, wherein the container lid can be removably mounted on the storage frame with the rim registered with the top end of the storage frame;

a drawer movably mounted within the storage frame for movement between an open position and a closed position, the drawer retracted within the storage frame when the drawer is in the closed position, and the drawer extended from the storage frame when the drawer is in the open position; and a first handle mounted to a first one of the side frames, and a second handle mounted to a second one of the side frames, the first and second handles pivotable between a first position wherein the handle is arranged to engage the container lid, and a second position wherein the handle is arranged to disengage the container lid.

2. The storage container of claim 1, wherein the container lid is pivotably mounted to the storage frame about an axis defined by the pivot.

3. The storage container of claim 2, wherein the container lid is arranged to be alternatively mounted to a first one of the side frames or to a second one of the side frames.

4. The storage container of claim 1, wherein the bottom frame comprises a bottom panel, and wherein the plurality of side frames includes a rear panel extending from and connected to the bottom panel, and a pair of upstanding side panels extending from and connected to the rear panel and the bottom panel.

5. The storage container of claim 1, wherein the side panels include a first end interconnected to the rear panel, and a second end, and wherein the storage frame includes a support beam extending between the second end of the side panels, the support beam cooperating with the side frames to define the opening into the storage frame interior.

6. The storage container of claim 1, wherein the handles are arranged for lifting the storage container.

7. The storage container of claim 1, wherein the bottom frame of the storage container is arranged to be stacked upon another container lid of a similarly arranged second storage container.

8. A storage container having a plurality of openings into the storage container, the storage container comprising:

a storage frame having a bottom frame, a pair of interconnected side frames extending from and connecting to the bottom frame and a rear frame extending from and connected to the bottom frame and the side frames, the side frames and the rear frame terminating at a top end that defines a first opening into a storage frame interior, and the side frames and the bottom frame terminating at a front end that defines a second opening into the storage frame interior;

a container lid arranged to be removably mounted on the storage frame such that the container lid at least partially covers the first opening into the storage frame interior, the container lid including a pivot extending from a side portion of the container lid, the pivot adapted to nest in a depression formed on at least one of the side frames;

a drawer insertable through the second opening and movable within the storage frame interior between an open position and a closed position, the drawer disposed within the storage frame when the drawer is in the closed position, and the drawer extended from the storage frame when the drawer is in the open and a first handle mounted to a first one of the side frames, and a second handle mounted to a second one of the side frames, the first and second handles pivotable between a first position wherein the handle is arranged to engage the container lid, and a second position wherein the handle is arranged to disengage the container lid.

9. The storage container of claim 8, wherein the container lid is pivotably mounted to the storage frame about an axis defined by the pivot.

10. The storage container of claim 8, wherein the container lid is arranged to be alternatively mounted to a first one of the side frames or to a second one of the side frames.

11. The storage container of claim 8, wherein each of the rear frame and the side frames is a panel constructed of at least one of polypropylene, polyethylene, polystyrene, metal, and glass.

12. The storage container of claim 8, wherein the handles are arranged to allow a user to lift the storage container.

13. The storage container of claim 8, wherein the bottom frame of the storage container is arranged to be stacked upon another container lid of a similarly arranged second container.

14. A storage container having a plurality of openings into the storage container, the storage container comprising:

a storage frame having a bottom panel, a pair of interconnected side walls extending from and connecting to the bottom panel and a rear wall extending from and connected to the bottom panel and the side walls, the side walls and the rear wall terminating at a top end that defines a first opening into a storage frame interior, and the side walls and the bottom panel terminating at a front end that defines a second opening into the storage frame interior, the side walls each having a projection extending outward from a top portion of the side wall, the projection including a first depression disposed near a first end of the projection and a second depression disposed near a second end of the projection;

a container lid arranged to be removably mounted on the storage frame such that the container lid at least partially covers the first opening, the container lid including a first pair of pivots extending from a first side of the container lid and a second pair of pivots extending from a second side of the container lid, each pair of pivots adapted to nest in the first and second depressions formed on one of the side walls, thereby forming first and second pivot axes for the lid respectively;

a handle disposed on each of the side walls, the handle including a pair of posts extending outward near a bottom portion of the handle, the pair of posts adapted to be received in post retainers formed on the side walls, the handle pivoting between a first position in which the handle engages and secures the container lid and a second position in which the handle disengages from the container lid; and a drawer insertable through the second opening and movable within the storage frame interior between an open position and a closed position, the drawer disposed within the storage frame when the drawer is in the closed position, and the drawer extended from the storage frame when the drawer is in the open position.

15. The storage container of claim 14 wherein the first and second depressions have a generally arcuate half cylinder shape.

16. The storage container of claim 14 wherein the handle includes a tab extending from a top portion of the handle and a detent extending from a bottom portion of the tab, the detent adapted to engage a portion of the container lid when the handle is in the first position.

* * * * *

UNITED STATES PATENT AND TRADEMARK OFFICE

CERTIFICATE OF CORRECTION

PATENT NO. : 7,387,350 B2
APPLICATION NO. : 10/798137
DATED : June 17, 2008
INVENTOR(S) : Timothy D. Killinger et al.

It is certified that error appears in the above-identified patent and that said Letters Patent is hereby corrected as shown below:

In the Claims:

Claim 8
Column 11, line 30 — Please delete "open and" and replace with --open position; and--.

Signed and Sealed this

Eighteenth Day of November, 2008

JON W. DUDAS
*Director of the United States Patent and Trademark Office*